US007439003B2

(12) United States Patent
Ishimaru et al.

(10) Patent No.: US 7,439,003 B2
(45) Date of Patent: Oct. 21, 2008

(54) MAGNETIC BLACK TONER FOR ELECTROPHOTOGRAPHY HAVING MN-CONTAINING HEMATITE COMPOUND AND MAGNETIC TWO-COMPONENT DEVELOPER FOR ELECTROPHOTOGRAPHY CONTAINING THE SAME

(75) Inventors: Seijirou Ishimaru, Ebina (JP); Sadaaki Yoshida, Ebina (JP); Yoshimichi Katagiri, Ebina (JP); Masahisa Ochiai, Kumagaya (JP)

(73) Assignee: Fuji Xerox Co., Ltd., Tokyo (JP)

( * ) Notice: Subject to any disclaimer, the term of this patent is extended or adjusted under 35 U.S.C. 154(b) by 392 days.

(21) Appl. No.: 11/136,384

(22) Filed: May 25, 2005

(65) Prior Publication Data

US 2006/0134542 A1 Jun. 22, 2006

(30) Foreign Application Priority Data

Dec. 22, 2004 (JP) ..... 2004-371576

(51) Int. Cl.
*G03G 9/083* (2006.01)

(52) U.S. Cl. ..... 430/106.2; 430/108.6; 430/108.21; 430/111.4; 430/111.41

(58) Field of Classification Search ..... 430/106.2, 430/108.21, 111.41, 111.4, 124.4, 108.6
See application file for complete search history.

(56) References Cited

U.S. PATENT DOCUMENTS

| | | | | |
|---|---|---|---|---|
| 4,859,550 | A | 8/1989 | Gruber et al. | |
| 4,931,374 | A * | 6/1990 | Tomita et al. | 430/106.2 |
| 4,946,755 | A * | 8/1990 | Inoue | 430/106.2 |
| 5,034,298 | A | 7/1991 | Berkes et al. | |
| 5,124,217 | A | 6/1992 | Gruber et al. | |
| 5,663,027 | A * | 9/1997 | Kohri et al. | 430/106.2 |
| 5,914,209 | A * | 6/1999 | Grushkin | 430/106.2 |
| 6,913,864 | B2 * | 7/2005 | Shimizu et al. | 430/108.6 |

FOREIGN PATENT DOCUMENTS

| | | |
|---|---|---|
| JP | A-02-134648 | 5/1990 |
| JP | 03140966 A * | 6/1991 |
| JP | A-05-080582 | 4/1993 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

* cited by examiner

*Primary Examiner*—Christopher RoDee
(74) *Attorney, Agent, or Firm*—Oliff & Berridge, PLC

(57) ABSTRACT

A magnetic black toner for electrophotography comprising a binding resin, a magnetic substance, and a pigment, wherein the pigment is at least one of phthalocyanine pigment and Mn containing hematite, and the content ratio of the magnetic substance and the pigment in the toner satisfy the following formulae: $10 \leqq A \leqq 30$, $0.1 \leqq B \leqq 3$, $5 \leqq C \leqq 40$, wherein A denotes the content ratio (mass %) of the magnetic substance in the toner, B denotes the content ratio (mass %) of the phthalocyanine pigment in the toner, and C denotes the content ratio (mass %) of the Mn containing hematite in the toner.

17 Claims, 2 Drawing Sheets

MAGNETIC BLACK TONER FOR ELECTROPHOTOGRAPHY HAVING MN-CONTAINING HEMATITE COMPOUND AND MAGNETIC TWO-COMPONENT DEVELOPER FOR ELECTROPHOTOGRAPHY CONTAINING THE SAME

BACKGROUND OF THE INVENTION

1. Field of the Invention

The present invention relates to a magnetic black toner for electrophotography for visualizing an electrostatic latent image formed on the surface of a photoconductive insulator such as a photoconductor drum in an electrophotography method or the like, to a magnetic two-component developer for electrophotography containing the same, to an image forming apparatus, and to an image forming method.

2. Description of the Related Art

Electrophotography is one conventional method for visualizing electric image data on recording paper or the like. In the electrophotography method, an electrostatic latent image is formed on the surface of a photoconductive insulator (photoconductor drum or the like; the latent image is developed and visualized by electrically attaching a one-component toner, which acquires charging with a developing machine equipped with a contact charging mechanism such as a blade, or a two-component toner, which acquires charging by being contacted with a carrier; and the visualized toner image is then transferred on the recording paper or the like. Finally, the transferred toner image is melted and solidified (fused) to produce a printed image.

The formation of the toner image on the surface of the photoconductive insulator may be performed as follows, for example. First, a uniform electrostatic charge is imparted to the surface of the photoconductive insulator (such as the photoconductor drum) by corona discharge or the like, and the electrostatic latent image is formed by radiating an optical image on the photoconductive insulator by suitable means. Next, the toner image is formed by attaching a charged toner to the electrostatic latent image using the electric attractive force of the electrostatic latent image. As the toner for developing the electrostatic latent image, particles which are produced as follows may be used. That is, a colorant and an additive such as a magnetic material and a charge control agent or the like, are dispersed in a binder resin made of a natural or a synthetic polymer material, and the binder resin dispersing the colorant therein is ground to produce fine particles having diameters from about 1 μm to about 30 μm.

Methods for fusing the toner image to the recording paper or the like, include those that involve melting the toner using the pressure, those in which the toner is heated, and those that use a combination of pressing and the heating, in all of which the molten toner becomes fused upon solidifying, as well as a method of irradiating the toner with let, and then solidifying and fusing the melted toner. The toner adhering to the recording paper forms a semipermanent image, and such printed images have become an indispensable part of modern society. Here, the selection of the colorant used for the toner in visualization is important, as it greatly affects image quality.

Images of electrophotography vary from "black and white" and "single color" to "full color" images, with full color images becoming increasingly common. However, the market for "black and white" images remains large, and even in full color equipment it is common that image formation is performed using four colors, that is, black in addition to yellow, magenta, and cyan. Thus, black material remains necessary in common electrophotography.

The black material of the toner is used as the toner after processing as follows. First, the black material is dispersed in a resin by mixing and kneading the black material with the resin. Then, the resin dispersing the black material therein is ground and classified to create a unified resin having a desired grain diameter, while organic and inorganic particles are added as determined necessary to achieve the desired fluidity, charge carrying capability, adjusting resistance, or the like. The material thus processed is then used as the toner. Conventionally, as the black material for electromagnetic toners, a magnetic material, commonly magnetite particle powder, has been used. In particular, a toner in which the black material is 50 mass % or more are commonly used in a magnetic one-component toner or the like as used in a one-component system process. Such a high content enables a sufficient degree of blackness to be obtained. Moreover, in a non-magnetic toner, carbon black particle powder and the like have been widely used as the black material.

Meanwhile, in recent years, there have been tests of a system in which an identification mark having a magnetic signature is printed on documents such as checks, convertible securities, bills, tickets, and the like, with the object of preventing forgery or alteration by means of a magnetic one-component toner development method using a magnetic toner containing a magnetic material therein. Moreover, a printed magnetic identification mark has been used as a check in the United States and in some European nations. Generally, such a system is referred to as a magnetic ink character recognition (MICR) system, and an MICR toner printer having a function of enabling reading with the MICR system has been placed on the market. The toner for printing an MICR font using an electrophotography system is called as a magnetic toner for an MICR printers (there is a case where the toner is simply called as an MICR toner), and such toners are disclosed in, for example, Japanese Patent Laid-Open Publications No. Hei 2-134648 and No. Hei 5-80582, and in U.S. Pat. No. 5,034,298. The MICR toner printer is a small-sized magnetic printer mainly, and uses the same process as employed in a conventional magnetic one-component toner. However, in order to enable reading by an MICR reader, a magnetic material having, in addition to the conventionally desirable characteristics, a predetermined remanent magnetic force and coercivity is used.

As described above, small-sized printers using magnetic one-component toners are currently the most commonly employed MICR printers. On the other hand, as the number of checks, bills, and the like in circulation is huge, a system capable of performing printing at a high speed and in a large quantities is desired. However, it is difficult for the above-mentioned small-sized printer to perform the high speed/large-quantity processing because of its magnetic one-component process, and a two-component system developer using a carrier is a more desirable process. Moreover, preferable magnetic properties are indispensable in MICR toners. However, if a magnetic one-component toner containing a magnetic material of 50 mass % or more is used as a two-component toner, then magnetic adsorptive power is generated in addition to electrostatic adsorption with the carrier, and a desired amount of toner adhesion is not obtained on printed matter to produce a failure of reading. Accordingly, it is necessary to lessen the content of the magnetic material necessary for the MICR property in the in two-component development for MICR.

However, there is a problem in which, when the quantity of the magnetic material is reduced, printed images appear reddish brown to deteriorate the printing quality because of the reddish brown color of the magnetic material.

Accordingly carbon black is sometimes added to the toner to prevent reddish-browning. However, although carbon black is a material having a very high masking rate and a high degree of blackness, carbon black particle powder is difficult to handle and complicates manufacturing of the toner because the carbon black particle powder are ultrafine particles of a bulky powder. Moreover, there are cases wherein the fusing property of the toner is reduced due to the increase of the viscosity of the toner caused by the filler effect according to the presence of the carbon black. Furthermore, there is a problem in that toner resistance is decreased due to the addition of the carbon black having a high electrical conductivity in addition to the magnetic material, and that fogging results.

Moreover, although it is also possible to use magnetite powder particles having weak magnetism in order to prevent reddish-browning, additional problems result when the magnetite powder particles are employed. For example, because the magnetite particles have strong cohesive forces among particles, the magnetite particles have inferior dispersibility, to the extent that the manufacturing property and the stability of the resistance and the charging property at the time of toner production can be impaired. Moreover, when the magnetite is used under a high temperature condition during the manufacturing process, the fusing process, or the like, the color of the magnetite may change from black to brownish-red.

SUMMARY OF THE INVENTION

The present invention relates to a magnetic black toner for electrophotography having a magnetic property such as an MICR property, an which maintains a printing quality such as the degree of blackness, while being capable of being used for a process enabling high speed/large-quantity processing in magnetic toners such as an MICR toner, to a magnetic two-component developer for electrophotography including the magnetic black toner, to an image forming apparatus, and to an image forming method.

The present invention is a magnetic black toner for electrophotography comprising a binding resin, a magnetic substance, and a pigment, wherein the pigment is at least one of phthalocyanine pigment and Mn containing hematite, and the content ratio of the magnetic substance and the pigment in the toner satisfy the following formulae:

$$10 \leqq A \leqq 30,$$

$$0.1 \leqq B \leqq 3, \text{ and}$$

$$5 \leqq C \leqq 40,$$

wherein A denotes the content ratio (mass %) of the magnetic substance in the toner, B denotes the content ratio (mass %) of the phthalocyanine pigment in the toner, and C denotes the content ratio (mass %) of the Mn containing hematite in the toner.

Moreover, the present invention provides a magnetic two-component developer for electrophotography comprising a toner and a carrier, wherein the toner comprising a binder resin, a magnetic substance, and a pigment, wherein the pigment is at least one of phthalocyanine pigment and Mn containing hematite, and the content ratio of the magnetic substance and the pigment in the toner satisfy the following formulae: $10 \leqq A \leqq 30$, $0.1 \leqq B \leqq 3$, and $5 \leqq C \leqq 40$, wherein A denotes the content ratio (mass %) of the magnetic substance in the toner, B denotes the content ratio (mass %) of the phthalocyanine pigment in the toner, and C denotes the content ratio (mass %) of the Mn containing hematite in the toner.

Moreover, the present invention also provides an image forming apparatus comprising a developing unit for developing a electrostatic latent image with a toner to form a toner image, a transfer unit for transferring the toner image onto a recording medium, and a fusing unit for fusing the toner image onto the recording medium, wherein the toner comprising a binder resin, a magnetic substance, and a pigment, wherein the pigment is at least one of phthalocyanine pigment and Mn containing hematite, and the content ratio of the magnetic substance and the pigment in the toner satisfy the following formulae: $10 \leqq A \leqq 30$, $0.1 \leqq B \leqq 3$, and $5 \leqq C \leqq 40$, wherein A denotes the content ratio (mass %) of the magnetic substance in the toner, B denotes the content ratio (mass %) of the phthalocyanine pigment in the toner, and C denotes the content ratio (mass %) of the Mn containing hematite in the toner.

Furthermore, the present invention further provides an image forming method including a developing process that develops a electrostatic latent image with a toner to form a toner image, a transfer process that transfers the toner image onto a recording medium, and a fusing process that fuses the toner image onto the recording medium, wherein the toner comprising a binder resin, a magnetic substance, and a pigment, wherein the pigment is at least one of phthalocyanine pigment and Mn containing hematite, and the content ratio of the magnetic substance and the pigment in the toner satisfy the following formulae: $10 \leqq A \leqq 30$, $0.1 \leqq B \leqq 3$, and $5 \leqq C \leqq 40$, wherein A denotes the content ratio (mass %) of the magnetic substance in the toner, B denotes the content ratio (mass %) of the phthalocyanine pigment in the toner, and C denotes the content ratio (mass %) of the Mn containing hematite in the toner.

According to the present invention, the kind of the pigment to be used and the amount of the magnetic substance and the pigment in the toner are optimized in the magnetic toner such as an MICR toner. Thereby, a magnetic black toner for electrophotography having a magnetic property such as an MICR property while maintaining a printing quality such as the degree of blackness, and being capable of being used for a process enabling high speed/large-quantity processing, a magnetic two-component developer for electrophotography including the magnetic black toner, an image forming apparatus, and an image forming method can all be provided.

BRIEF DESCRIPTION OF THE DRAWINGS

A preferred embodiment of the present invention will be described in detail based on the following figures, wherein.

DETAILED DESCRIPTION OF THE INVENTION

Figure 1:
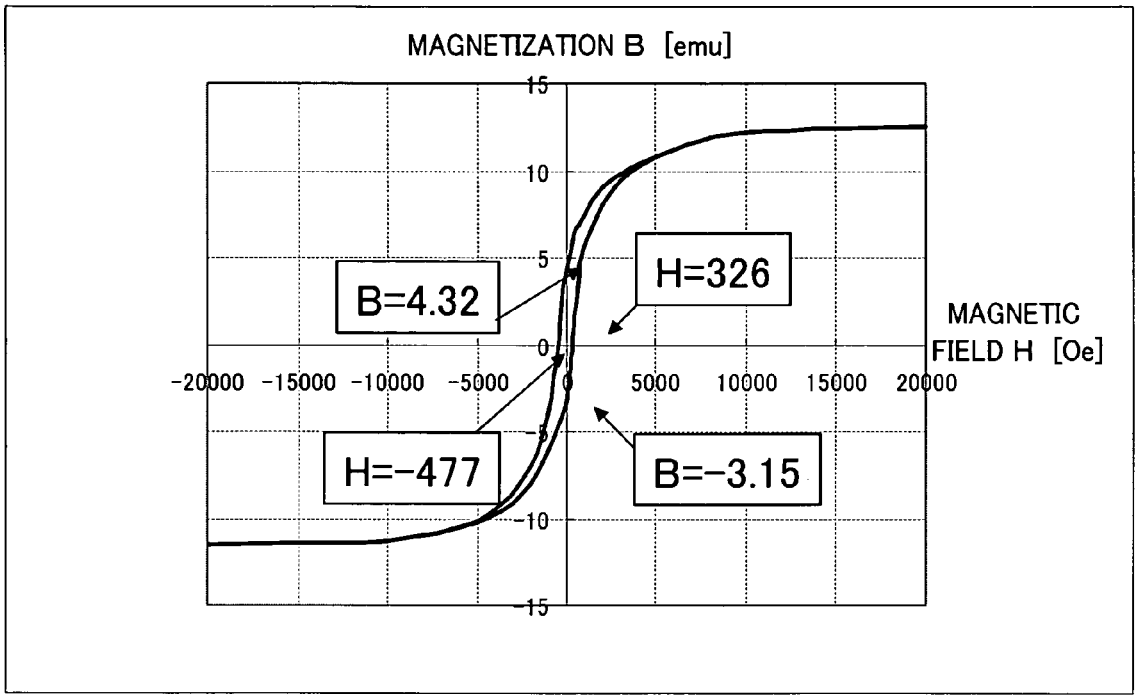
FIG. 1 is a view showing an example of the B-H characteristic curve of a magnetic substance used for a magnetic black toner for electrophotography according to an embodiment of the present invention.

In the following, embodiments of the present invention will be described.

(Magnetic Black Toner for Electrophotography)

A magnetic black toner for electrophotography according to the present embodiment contains a binding resin, a magnetic substance, and a pigment. The pigment is at least one of a phthalocyanine pigment and a Mn containing hematite, and the content ratio of the magnetic substance and the pigment in the toner satisfy the following formulae, wherein A denotes the content ratio (mass %) of the magnetic substance in the toner, B denotes the content ratio (mass %) of the phthalocyanine pigment in the toner, and C denotes the content ratio (mass %) of the Mn containing hematite in the toner:

$$10 \leqq A \leqq 30,$$

$$0.1 \leqq B \leqq 3, \text{ and}$$

$$5 \leqq C \leqq 40.$$

When A, B, or C fall outside of the above-defined ranges, the magnetic properties, such as an MICR function, may not be satisfied and the blackness of a fused image may be impaired.

Moreover, in order to further improve the MICR property such as the reading characteristic by an MICR reader, it is preferable that the A of the magnetic substance in the toner is in a range of $10 \leqq A \leqq 30$. If the A of the magnetic substance in the toner is less than 10 mass %, reading failure by the MICR reader becomes likely. Moreover, if the A of the magnetic substance in the toner is more than 30 mass %, the magnetic adsorption force with a carrier may become too large and the amount of development lacks.

Although the range of B (mass %) of the phthalocyanine pigment in the toner may be $0.1 \leqq B \leqq 3$, it is generally preferable that $0.5 \leqq B \leqq 2$. When the B of the phthalocyanine pigment in the toner is less than 0.1 mass %, the B content is insufficient for optimization of the degree of blackness by the phthalocyanine pigment, and the fused image may become a reddish brown color, and therefore deteriorate the printing quality. Moreover, if the B of the phthalocyanine pigment in the toner is more than 3 mass %, it is possible that the printing will not become black, but will have an increased cyan color.

Moreover, although the C (mass %) of the Mn containing hematite in the toner may be $5 \leqq C \leqq 40$, it is generally preferable that C be $7 \leqq C \leqq 30$. If the C of the Mn containing hematite in the toner is less than 5 mass %, it may not always be possible to resolve the reddish-browning of a fused image. Moreover, if the C of the Mn containing hematite in the toner is more than 40 mass %, the relative amount of the resin in the toner may decrease, leading to failure to fuse.

In the present embodiment, it is preferable that A, B, and C further satisfy the following formulae:

$$A = \alpha B (10 \leqq \alpha \leqq 40),\ A = \beta C (0.1 \leqq \beta \leqq 6)$$

It is more preferable that the value $\alpha$ is within a range of $15 \leqq \alpha \leqq 30$. Moreover, it is more preferable that the value $\beta$ is within a range of $10 \leqq \beta \leqq 25$. If $\alpha$ and $\beta$ are out of theses ranges, the magnetic property such as the MICR function cannot be assured, and there will be cases wherein the blackness property of a fused image will be impaired.

The magnetic black toner for electrophotography according to the present embodiment is preferably used as a magnetic toner for MICR used for an MICR system. Consequently, as the magnetic property of the magnetic black toner for electrophotography according to the present embodiment, it is preferable to adjust remanent magnetization to be within a range of from about 5 $A \cdot m^2/kg$ to about 20 $A \cdot m^2/kg$, and to adjust coercivity to be within a range of from about 20 kA/m to about 40 kA/m. Thereby, the characteristics of the MICR reader can be stabilized. Moreover, it is more preferable that the remanent magnetization of the toner is within a range of from about 5 $A \cdot m^2/kg$ to about 15 $A \cdot m^2/kg$, and it is still more preferable that the remanent magnetization is within a range of from about 5 $A \cdot m^2/kg$ to about 12 $A \cdot m^2/kg$. It is more preferable that the coercivity of the toner is within a range of from about 25 kA/m to about 35 kA/m, and it is still more preferable that the coercivity is within a range of from about 27 kA/m to about 33 kA/m. If the remanent magnetization of the toner is less than about 5 $A \cdot m^2/kg$, there is the possibility of the occurrence of the failure of the reading of the MICR reader. If the remanent magnetization is larger than about 20 $A \cdot m^2/kg$, there is the possibility of the occurrence of the failure of reading on the side of the stronger magnetic force. Moreover, if the coercivity of the toner is smaller than about 20 kA/m, there is the possibility of the occurrence of the failure of reading in the MICR reader. If the coercivity is larger than about 40 kA/m, there is the possibility of the occurrence of the failure of reading on the side of the stronger magnetic force.

Moreover, in the magnetic black toner for electrophotography according to the present embodiment, it is preferable that the remanent magnetization is within a range of from about 10 $A \cdot m^2/kg$ to about 45 $A \cdot m^2/kg$ because the magnetic black toner has MICR properties such as the read-in property by the MICR reader, and it is more preferable that the remanent magnetization is within a range of from about 20 $A \cdot m^2/kg$ to about 35 $A \cdot m^2/kg$. It is preferable that the coercivity of the magnetic substance contained in the toner is within a range of from about 10 kA/m to about 45 kA/m, and it is more preferable that the coercivity is within a range of from about 20 kA/m to about 35 kA/m. If the remanent magnetization of the magnetic substance is smaller than about 10 $A \cdot m^2/kg$, the magnetic force decreases before the reading by the MICR reader, and the failure of the reading by the MICR reader becomes more likely. If the remanent magnetization is larger than about 45 $A \cdot m^2/kg$, the adsorption force by the magnetic force between the toner and the carrier may relatively increase, causing and the amount of development to become insufficient. Moreover, if the coercivity of the magnetic substance is smaller than about 10 kA/m, the magnetic force does not reach one which can be read with the MICR reader. Consequently, the failure of reading becomes more likely. If the coercivity is larger than about 45 kA/m, the adsorption force by the magnetic force between the toner and the carrier may relatively increase, causing and the amount of development to become insufficient.

Incidentally, the remanent magnetization and coercivity of the toner and the magnetic substance are values obtained using a "vibrating sample magnetometer VSM-3S-15" (manufactured by Toei Industry Co., LTD) in the maximum external magnetic field of 10 kOe. More concretely, the toner or the magnetic substance (about 0.4 g) is densely filled in a capsule made of polyethylene (shaped in a size of 8 mmϕ in diameter×12 mm in height), and a lid is fastened with absorbent cotton used as a holding member. The mass of the magnetic substance having been pre-measured, the magnetic substance is set in a holder. As the measurement of saturated magnetization, a magnetic field is applied up to 10 kOe, and the remanent magnetization and the coercivity are calculated based on a B-H characteristic record and a B-H characteristic curve.

An example of the B-H characteristic curve of the magnetic black toner for electrophotography according to the present embodiment is shown in FIG. 1. In FIG. 1, the abscissas axis indicates magnetic field H [Oe], and the ordinate axis indicates magnetization B [emu]. The magnetization B at the magnetic field H being zero in FIG. 1 is the remanent magnetization here, and the magnetic field H at the magnetization B being zero is the coercivity. An example of an actual measurement will be given according to FIG. 1. As a result of weighing the 0.323 g of magnetic black toner according to the present embodiment, remanent magnetization and coercivity were as followed in case of being expressed by the SI unit system: the remanent magnetization ($\sigma r$)=(4.32+3.15)×(1/2)×(1/0.323)=11.6 [$A \cdot m^2/kg$](1 emu/g=1 $A \cdot m^2/kg$), and the coercivity (iHc)=(477+326)×(1/2)×(0.55/4π)=17.6 [kA/m](1 Oe=1/4π kA/m). In the above, the value 0.55 is the correction coefficient of the measurement equipment.

Although, for example, any one of magnetite, ferrite and the like can be employed as the magnetic substance having the magnetic properties such as the remanent magnetization and the coercivity, of these, magnetite is generally preferable because a high remanent magnetization can be obtained. Moreover, there are no especial restrictions as to the shape of the magnetic substance as long as the magnetic substance satisfies the remanent magnetization and the coercivity. For example, any of a needle, a globe, a hexahedron, an octahedron, an indeterminate form, or the like may be employed. Among these, in order that the value of the remanent magnetization may be within the range of from about 10 $A \cdot m^2/kg$ to about 45 $A \cdot m^2/kg$, a needle shape is preferable for the magnetic substance.

Here, as the definition of the shape of the needle, shapes having an average value of ratios L1/L2, being about 2 or more, of the lengths L1 in the directions of longer axes and the lengths L2 in the directions of shorter axes of 10 or more particles of the magnetic substance when the shapes are observed with an electron microscope generally used are defined as needles. Preferably, in the needle shape, L1/L2≧3, and more preferably L1/L2≧5.

Moreover, as for the degree of blackness of a fused image formed with the magnetic black toner for electrophotography according to the present embodiment, it is preferable that an a* value is within a range of from about −5.0 to about 5.0 and a b* value is within a range of from about −5.0 to about 5.0 in an L*a*b* calorimetric system. If each of these values is out of the ranges, there is a case where a good degree of blackness cannot be obtained. Furthermore, if the hue of the black is taken into consideration, it is preferable that the L* value is within a range of from about 10 to about 40, it is more preferable that the L* value is within a range of from about 10 to about 30, and it is still more preferable that the L* value is within a range of from about 15 to about 25. It is more preferable that the a* value is within a range of from about −3.0 to about 3.0, and it is especially preferable that the a* value is within a range from about −1.0 to about 1.0. It is more preferable that the b* value is within a range of from about −3.0 to about 3.0, and it is especially preferable that the b* value is a range of from about −1.0 to about 1.0.

Here, a color coordinate is one obtained by measuring each of a calorimetric indices L* value, a* value and b* value of a solid image using the toner according to the present embodiment with X-Rite 938 (2 degree of visual field of a light source D50). In addition, the a* value indicates redness. That the a* value becomes larger indicates that the redness is stronger. The b* value indicates yellowness. That the b* value becomes larger indicates that the yellowness is stronger. The L* value indicates brightness. In addition, the reddish brown property can be confirmed also by visual observation.

In the present embodiment, although phthalocyanine blue, phthalocyanine green, and the like can be cited as examples of phthalocyanine pigments which may be employed in the present embodiment, of these, phthalocyanine blue is more preferable in order to increase the degree of blackness. As the phthalocyanine blue, for example, β copper phthalocyanine (C. I. Pigment Blue 15:3 and the like), α copper phthalocyanine (C. I Pigment Blue 15), ϵ copper phthalocyanine (C. I. Pigment Blue 15:6 and the like), and the like are preferably used, and the β copper phthalocyanine (C. I. Pigment Blue 15:3 and the like) and the α copper phthalocyanine (C. I Pigment Blue 15) are more preferably used.

Moreover, as the Mn containing hematite, any compound containing Mn and including $Fe_2O_3$ as the main component and which can make the printing quality of a fused image black, can be used as the Mn containing hematite without any special limitations. An example of the manufacturing method of a pigment having the hematite structure containing Mn may be as follows. That is, a suspension containing magnetite particles, and Mn or Mn and iron are added in the state of an aqueous solution. By oxidizing the suspension with heating, the suspension becomes the state in which Mn compound, or Mn compound and Fe compound, is uniformly mixed with the magnetite particles, or the state in which the existing Mn compound, or Mn compound and Fe compound, covers the surfaces of the magnetite particles. The mixed particles of Mn compound-magnetite, or the mixed particles of Mn compound-Fe compound-magnetite, in these suspensions are washed using water and dried. Then, the mixture particles are calcined by heating the suspensions within a high temperature range of from about 600° C. to about 1100° C. Thereby, black particles with substantially weak magnetism or completely non-magnetic can be obtained. Moreover, the black particles have the hematite structure, in which Fe is contained as the main component and Mn is melted in the Fe, and have remanent magnetization as of about 2 $A \cdot m^2/kg$ or less.

When the calcination temperature at the time of manufacturing the Mn containing hematite is about 600° C. or less, conversion of the magnetite to hematite is impaired, while the ability of the Mn containing hematite to hold a magnetic force is improved. Moreover, when the calcination temperature is about 1100° C. or more, desired grain diameters may become unobtainable due to the cohesion of particles. A more preferable calcination temperature range is therefore from about 700° C. to about 1000° C. Moreover, it is preferable that the Mn content is within a range of from about 3 mass % to about 30 mass %, more preferably about 10 mass % to about 30 mass %, and still more preferably about 20 mass % to about 25 mass %. If the content of Mn is less than about 3 mass %, the degree of blackness falls. If the content of Mn is more than about 30 mass %, the degree of brown may become relatively great.

The Mn containing hematite has a high degree of blackness, and a weak magnetic force or is non-magnetic. In addition, the Mn containing hematite has very little remanent magnetization. Consequently, by forming a toner containing such Mn containing hematite, the reddish-browning owing to the magnetic substance can be cancelled without increasing the adhesive force to the carrier, and thereby a magnetic toner having a sufficient degree of blackness can be obtained.

In the magnetic black toner for electrophotography according to the present embodiment, either or both of a phthalocyanine pigment or Mn containing hematite may be added to the magnetic substance. Moreover, the relationship between the contents (B and C) of the respective phthalocyanine pigment and the Mn containing hematite in the toner in the case of adding both of the phthalocyanine pigment and the Mn containing hematite, and the relation (α and β) against the content A of the magnetic substance in the toner follow the above-mentioned formulae. Here, it is preferable that (A+B+C)≦70 mass % in such a case.

Moreover, in order to have the MICR property such as the read-in property by the MICR reader, and the like, it is preferable that the remanent magnetization σs of the phthalocyanine pigment and the Mn containing hematite is about 2

$A \cdot m^2/kg$ or less, it is more preferable that the remanent magnetization σs is about 1.5 $A \cdot m^2/kg$ or less, and it is still more preferable that the remanent magnetization as is about 1 $A \cdot m^2/kg$ or less.

Moreover, it is preferable that the volume resistivity values of the phthalocyanine pigment and the Mn containing hematite are about $10^5$ Ωcm or more. For a dual component toner, the magnetic substance included the toner caused the toner to have a low resistance. Because the toner further turns to have a lower resistance and becomes difficult to charge in case of using a material having a high electrical conductivity as the pigment in order to secure the degree of blackness, there is a case where the use of the material results in fogging. Moreover, because fusing property of the toner falls as a result of the opacifying power of the magnetic substance, it is preferable to suppress the reduction of the resistance of the toner in order to use the magnetic toner as the two component system developer.

The volume resistivity value may be measured as follows. On the lower polar plate of a measuring jig being a pair of circular polar plates (made of steel) each having a diameter of 20 $cm^2$ and being connected with an electro meter (such as the commercially available KEITHLEY 610C manufactured by Keithley Instruments, Inc.), and a high-voltage power supply (commercially available FLUKE 415B manufactured by Fluke Corporation), a sample is placed so as to form a flat layer having a thickness within a range of from about 1 mm to about 3 mm. Subsequently, after placing the upper polar plate on the sample, a weight of 4 kg is placed on the upper polar plate in order to remove any gaps between the sample and the polar plates. The thickness of the sample layer is measured in this state. Subsequently, by applying a voltage between both the polar plates, a current value is measured and the volume resistivity value is calculated in accordance with the following formula.

volume resistivity value=applied voltage×20÷(current value−initial current value)÷sample thickness The initial current value is a current value at the time when the applied voltage is 0 in the formula, and the current value shows a measured current value.

Because the magnetic black toner for electrophotography according to the present embodiment has a high degree of blackness, the magnetic black toner also has a high light absorbing property. Accordingly, a thermal fusing system or the like can be used as a method for solidifying and fusing a toner image transferred on recording paper or the like after heating and melting the image. The magnetic black toner can be preferably used for a flash fusing toner of a flash fusing system performing the fusing of the toner on recording paper after radiating light energy to melt the toner. In a flash fusing toner, the wavelengths of the light emitted from a light source are widely distributed from visible light to near infrared light, and black series, which have higher degrees of blackness and can absorb the whole wavelength region of a light source, are advantageous for absorbing the light. Accordingly, the magnetic black toner for electrophotography according to the present embodiment is a toner which has attained the turning to blackness in order to act usefully also in a flash fusing system (flash fusing). The magnetic black toner for electrophotography according to the present embodiment can be used as a two-component developer, and further can be fused by the flash fusing system (flash fusing). Consequently, the magnetic black toner for electrophotography can be processed at a high speed and in large quantities. For example, the magnetic black toner for electrophotography can process at a high speed and in large a quantity about 100 sheets or more of A-4 size sheet per minute, preferably about 200 sheets or more of A-4 size sheet per minute (ppm), and more preferably about 400 sheets or more of A-4 size sheet per minute (ppm).

The magnetic black toner for electrophotography according to the present embodiment contains a binding resin (binder resin) in addition to the magnetic substance. As the binder resin to be used, various kinds of well-known thermoplastic resins including natural or synthetic polymers can be used, including, for example, epoxy resins, styrene-acrylic resins, polyacrylic resins, polyamide resins, polyester resins, polyvinyl resins, polyurethane resins, and polybutadiene resins. In particular, polyester resins are preferably adopted. The mass rate of the binder resin in the toner is within a range of from 27 mass % to 89.9 mass % to the mass of the toner, and it is preferable that the mass rate is within a range of from about 40 mass % to about 85 mass %.

In the magnetic black toner for electrophotography according to the present embodiment, the toner may be configured by dispersing a charge control agent for controlling the amount of the charging of the toner in a desired range into the binder resin in addition to the binder resin. As the charge control agent, a positive polarity charge control agent and a negative polarity charge control agent may be selected according to whether the binder resin is charged to be plus or whether the binder resin is charged to be minus. For example, as the positive polarity charge control agent, a nigrosine dye, a $4^{th}$ class ammonium salt, a triphenylmethane derivative, or the like may be used. As the negative polarity charge control agent, a metal-containing azo complex, a naphthol acid zinc complex, a salicylic acid zinc complex, a calix arene series compound, or the like may be used. It is preferable that the amount of the charge control agent in the toner is within a range of from about 0.1 mass % to about 5 mass % to the mass of the toner, and it is more preferable that the amount is within a range of from about 0.3 mass % to about 3 mass %.

In the magnetic black toner for electrophotography according to the present embodiment, a wax may be used as a release agent in addition as occasion demands. The wax may be, for example, low molecular weight polyolefins such as polyethylene, polypropylene and polybutene; silicones which exhibit a softening point when heated; fatty acid amides which exhibit a softening point when heated such as oleamide, erucamide, ricinoleamide and stearamide; plant-based wax which exhibits a softening point when heated such as carnauba wax, rice wax, candelilla wax, sumacs wax and jojoba oil; animal-based wax which exhibits a softening point when heated such as beeswax; mineral-based wax and petroleum-based wax which exhibit a softening point when heated such as montan wax, ozokerite, ceresin, paraffin wax, microcrystalline wax and Fischer-Tropsh wax; ester wax obtained from higher fatty acid and higher alcohol which exhibits a softening point when heated such as stearyl stearate and behenyl behenate; ester waxes obtained from higher fatty acid and monovalent or multivalent lower alcohol which exhibit a softening point when heated such as butyl stearate, propyl oleate, glyceride monostearate, glyceride distearate and pentaerythritol tetra behenate; ester waxes obtained from higher fatty acid and multivalent alcohol multimer which exhibit a softening point when heated such as diethyleneglycol monostearate, dipropyleneglycol distearate, diglyceryl distearate and triglyceryl tetrastearate; sorbitan higher fatty acid ester waxes which exhibit a softening point when heated such as sorbitan monostearate; or cholesterol higher fatty acid ester waxes which exhibit a softening point when heated such as cholesteryl stearate.

As for the quantity of the wax in the toner, it is preferable that the quantity is within a range of from about 0.1 mass % to about 10 mass % to the mass of the toner, and also it is more preferable that the quantity is within a range of from about 0.3 mass % to about 5 mass %. If the quantity of the wax in the toner is less than about 0.1 mass %, document offset, in which a fused image shifts to the opposed paper or an opposed image by a heat or a pressure, may arise since the quantity is insufficient as the absolute quantity of the wax. If the amount of wax in the toner exceeds about 10 mass %, the viscoelasticity of the toner which melts at the time of fusing falls extremely, and hot offset may occur or obstacles such as filming may occur.

In addition, as the need arises, a metallic soap such as zinc stearate, or a fusing assistant agent such as a surface active agent may be dispersed in the binder resin.

When the magnetic black toner for electrophotography according to the present embodiment is employed in electrophotography equipment of a flash fusing system, if an infrared light absorbent, for example, is further added as the need arises, in addition to the magnetic substance, the colorant, the binder resin, the charge control agent and the wax, then the addition works more suitably.

Furthermore, as for the magnetic black toner for electrophotography according to the present embodiment, it is preferable to mix and use inorganic fine particles such as a fluidity improving agent. As the inorganic fine particles used in the present embodiment, it is preferable that primary particle diameters are within a range of from about 5 nm to about 2 μm, and it is more preferable that the primary particle diameters are within a range of from about 5 nm to about 500 nm. Moreover, the specific surface area by the BET method is preferably within a range of from about 20 $m^2/g$ to about 500 $m^2/g$. The ratio of the inorganic fine particles mixed into the toner is within a range of from about 0.01 mass % to about 5 mass % to the toner, and it is more preferable that the ratio is within a range of from about 0.01 mass % to about 2 mass %. As such inorganic fine particles, there can be cited, for example, silica fine powder, alumina, titanium oxide, titanium acid barium, titanium acid magnesium, titanium acid calcium, titanium acid strontium, zinc oxide, silica sand, clay, mica, tabular spar, diatomaceous earth, chromium oxide, cerium oxide, colcothar, antimony trioxide, magnesium oxide, zirconium oxide, barium sulfate, barium carbonate, calcium carbonate, silicon carbide, silicon nitride, and the like. Silica fine powder is especially preferable.

(Method of Manufacturing Magnetic Black Toner for Electrophotography)

A method of manufacturing the magnetic black toner particles for electrophotography according to the present embodiment is not especially restricted, and the magnetic black toner particles can be manufactured by a conventionally well-known method. For example, the magnetic black toner particles can be manufactured by the well-known kneading and grinding method in which a predetermined amount of a binder resin, and a predetermined amount of the magnetic substance and colorant are mixed, kneaded, and ground. For example, a mixture of the magnetic substance, the colorant, and the binder resin, and further a wax, a charging control agent and other additives and the like as desired or required by circumstances may be sufficiently mixed with a mixer. After that, the resin and the like are fused and kneaded to be made compatible with the heating and kneading machine, and the resin and the like are cooled and solidified to obtain a resin kneaded substance. Thus, the black toner particles having desired particle sizes can be obtained by grinding and classifying the resin kneaded substance. As the kneading machine, a Henschel mixer, a ball mill, and the like may be used. The kneading can be performed using various heating and kneading machine such as a three roll type, a one-axis screw type, a two-axis screw type, and a Banbury mixer type. The grinding of the kneaded substance is performed using, for example, a Micronizer, an Ulmax, a Jet-O-Mizer, a krypton (KTM), a turbo mill, an I type jet-mill or the like. The classifying is performed by using an elbow jet of a wind force type which uses the Coanda effect. Furthermore, the shapes can be changed by applying heat wind using the commercially-available Hybridization System (manufactured by Nara Machinery Co., Ltd.), Mechanofusion System (manufactured by Hosokawa Micron Corporation), Kryptron System (manufactured by Kawasaki Heavy Industries, Ltd.), or the like as a post-process, and conglobation by the hot wind is also possible.

Methods of manufacturing the toner particles include the suspension polymerization method and the emulsion polymerization aggregation method. In the suspension polymerization method, black toner particles having desired grain sizes can be formed by adding a monomer composition obtained by melting or dispersing a mixture of the magnetic substance, the colorant and the binding resin, and further an added polymerization initiator, a crosslinking agent, a charging control agent, and the other additives as the need arises, into an aqueous phase while stirring the aqueous phase to perform the granulation and the polymerization of the particles. In the emulsion polymerization aggregation method, an emulsifying agent is added in a process of performing the polymerization by dispersing the magnetic substance, the colorant and the binding resin, and further the polymerization initiator and the like as occasion demands, into water, and thereby it is possible to form the black toner particles having desired particle sizes.

In the magnetic black toner for electrophotography according to the present embodiment, the mixture of the toner particles with the external additives can be performed by a well-known method. For example, the mixture can be performed by fully mixing the toner particles and the external additives with a mixer. As the mixer, the Henschel mixer, a ball mill, or the like can be used.

(Two-Component Developer)

The magnetic black toner for electrophotography according to the present embodiment is used as a two-component developer. As a core material of the carrier used in two-component development, a material having saturated magnetization being within a range of from about 30 $A \cdot m^2/kg$ to about 120 $A \cdot m^2/kg$ is generally used, and a material having the saturated magnetization being within a range of from about 50 $A \cdot m^2/kg$ to about 100 $A \cdot m^2/kg$ is more preferable. As such, a core material of the carrier, for example, a manganese-strontium (Mn—Sr) series ferrite having the saturated magnetization within a range of from about 50 $A \cdot m^2/kg$ to about 100 $A \cdot m^2/kg$, or a manganese-magnesium (Mn—Mg) series ferrite having the saturated magnetization within the range of from about 50 $A \cdot m^2/kg$ to about 100 $A \cdot m^2/kg$ can be cited. Moreover, although some of iron powder and magnetite having high magnetization about 100 $A \cdot m^2/kg$ or more and about 75-120 $A \cdot m^2/kg$, respectively, may generate stripes in printing, these materials can be preferably used in view of securing image density. Moreover, in a copper-zinc (Cu—Zn) series ferrite having weak magnetization (about 30-80 $A \cdot m^2/kg$), it is possible to weaken the hit of developer blush height to a photo conductor, to thereby improve image quality.

As grain diameter of the core material of the carrier, it is preferable that the average grain diameter is within a range of from about 10 μm to about 150 μm, and it is more preferable that the average grain diameter is within a range of from about 40 μm to about 100 μm. If the average grain diameter of the core material of the carrier is less than about 10 μm, fine powder series increases in the distribution of carrier particles, and the magnetization per one particle becomes low, and carrier scattering may result. Meanwhile, if the average grain diameter of the core material of the carrier exceeds about 150 μm, the specific surface area falls and of toner scattering may arise.

As a solvent for forming a carrier covering resin layer, toluene, xylene, methyl ethyl ketone, methyl isobutyl ketone, butyl cellosolve acetate, or the like may be used. As the amount of resin covering in the resin covering carrier, preferable amounts are within a range of from about 0.01 mass parts to about 5.0 mass parts to the total amount of the resin covering carrier because, when the amount of the resin covering is less than about 0.01 mass parts, formation of a uniform layer covering on the surface of the core material of the carrier may become problematic or impossible while, when the amount of the resin covering exceeds about 5.0 mass parts, the covering layer may tend to become too thick, resulting in granulation of the carrier particles, and therefore making it impossible to obtain uniform carrier particles.

If increasing the service life is taken into consideration, the carrier is preferably coated by a silicone resin. The method of forming the covering resin layer on the core material of the carrier is as follows. That is, after dissolving a silicone series resin, an acrylic modified silicone series resin, a fluorine modified silicone resin, or the like in a solvent, the core material of the carrier is uniformly coated with the same resin solution by dipping, spraying, brush coating, or the like. Subsequently, the solvent is removed by drying and baked. As the baking apparatus, any of an external heating system or an internal heating system may be adopted. For example, a fixed type or a fluid type electric furnace, a rotary type electric furnace, or a burner furnace may be adopted. Alternatively, baking using microwave radiation may be adopted. Furthermore, the developing ability may be raised by achieving the lowering of resistance by adding an electric conduction component during coating the carrier.

As the electric conduction component, for example, carbon black manufactured by the conventionally well-known thermal black method, the acetylene black method, the channel black method, the lamp black method, or the like may be suitably employed. It is preferable that the static resistance value of the carrier is about 10E10 Ω or less, more preferably about 10E7 Ω or less, and still more preferably about 10E5 Ω or less.

(Image Forming Apparatus and Image Forming Method)

Figure 2:
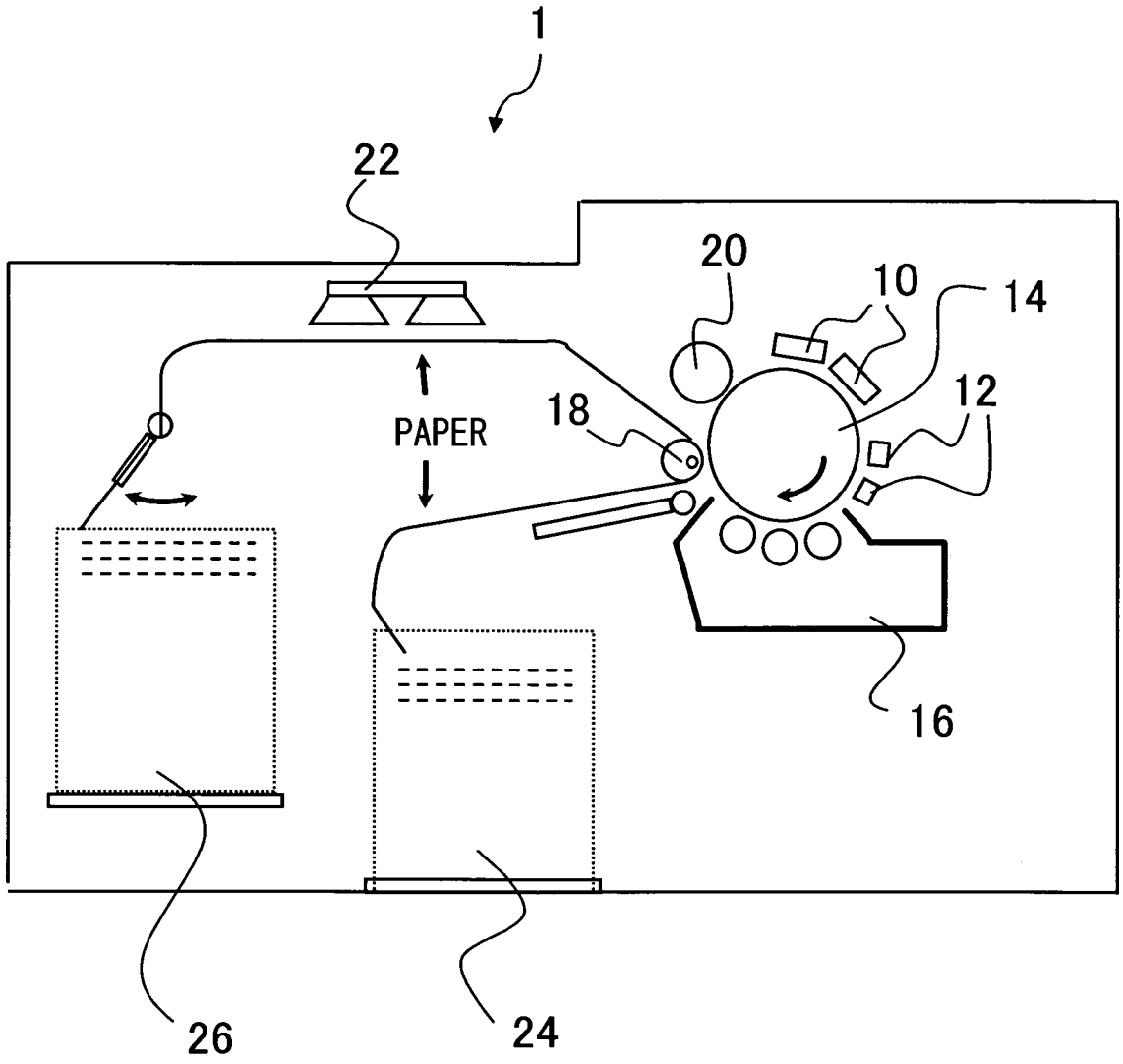
FIG. 2 is a view showing an example of the configuration of an image forming apparatus according to an embodiment of the present invention.

An image forming apparatus using the magnetic black toner for electrophotography according to the present embodiment is equipped with a charging unit, an exposure unit, a developing unit, a transfer unit, a fusing unit and the like. An example of the image forming apparatus according to the present embodiment is shown in FIG. 2. The image forming apparatus 1 is equipped with a charging unit 10, an exposure unit 12, a photoconductor drum 14, a developing unit 16, a transfer unit 18, a cleaning unit 20, a fusing unit 22, a hopper 24, a stacker 26, or the like.

First, an electrostatic charge image is formed on a photoconductive insulator of the photoconductor drum 14 or the like by the charging unit 10 and the exposure unit 12. The electrostatic charge image is developed to be an electrostatic latent image by the developing unit 16 with a developer including a toner. The developed electrostatic latent image is transferred to a recording medium such as paper by the transfer unit 18, and the fusing unit 22 then fuses the electrostatic latent image to visualize the image. In the developing unit, it is preferable to use the magnetic black toner for electrophotography according to the present embodiment.

An image forming method using the magnetic black toner for electrophotography according to the present embodiment is an image forming method including a process of forming an electrostatic charge image on a photoconductive insulator of the photoconductor drum 14 or the like, a process of forming a toner image by developing the electrostatic charge image on the surface of a developer carrying body with a developer containing a toner, a process of transferring the toner image to the surface of a recording medium, and a process of fusing the toner image. In the developing process, it is preferable to use the magnetic black toner for electrophotography according to the present embodiment. In addition, in the process of transferring the toner image onto the transfer material, the process may be performed by a system of transferring the toner image on the electrostatic latent image carrier to the recording medium directly, or the process may be performed by a system of transferring the toner image onto the recording medium through an intermediate transfer body.

As the development method of the toner, a development method such as the magnetic two-component development method can be used for image formation. In the two-component development method, the toner is mixed and agitated with the carrier in the developing unit 16 in which magnet rollers have been arranged, for example. Thereby, the toner is charged by the friction with the carrier, and the charges are held on the surface of the rotating magnet rollers in the state of developer blush height to form a magnetic brush. Usually, the photoconductive insulator of the photoconductor drum 14 or the like is arranged to adjoin to the magnet rollers, and the electrostatic latent image is formed on the photoconductor drum 14 as described above. Consequently, a part of the toner on the surfaces of the magnet rollers moves to the surface of the photoconductor drum 14 by an electric absorption force, such that the electrostatic latent image is thereby developed to form a toner image on the surface of the photoconductor drum 14. After the toner image has been transferred by the transfer unit 18 on a recording medium such as recording paper, the toner image is fused on the recording medium by the fusing unit 22, such as a heat roller or a flash lamp as shown in FIG. 2.

Moreover, a light back surface system performing the development by exposing to the developing unit 16 from the back of the photo conductor may be adopted. In a high speed printer system coping with the improvement of the information processing speed in recent years, the two-component system developer is preferably used from the viewpoints of a life and the like.

Moreover, as the photo conductor of the photoconductive insulator (such as the photoconductor drum), inorganic photo conductors such as an amorphous silicon and selenium, and organic photo conductor such as polysilane and phthalocyanine, can be generally used.

(Flash Fusing)

An example wherein the magnetic black toner for electrophotography according to the present embodiment is used as a toner for flash fusing will be described. In a process of fusing an image visualized by the use of the developer containing the toner after the image has been transferred on the recording medium, it is preferable to use the flash fusing system as the toner fusing system. The flash fusing system can be implemented, for example, by radiating light to the visualized image transferred on the recording medium with a flash fusing device. The flash fusing device has at least a flash fusing device (flash lamp) which radiates light energy. Any number of flash fusing unit may be provided. As for the flash fusing device (flash lamp), there is no especial restriction, and it can be chosen suitably according to the purpose. For example, an infrared lamp, a halogen lamp, a xenon lamp, or the like can all be preferably employed.

Suitable light can be provided according to the specification of the flash fusing equipment, including light of a wide wavelength region ranging from visible light to infrared light. For example, the toner can be fused efficiently using a xenon lamp as the flash light. Moreover, the emission energy per unit area of one time of the flash light which shows the lamp intensity of xenon is preferably within a range of from about 1 J/cm$^2$ to about 3 J/cm$^2$ when being expressed by an emission energy density. When the emission energy is less than the numerical range, it may be unable to fuse the toner in a good state. On the other hand, when the emission energy exceeds the numerical range, toner voids, scorching of the paper, and the like may occur. The emission energy density S (J/cm$^2$) may expressed by the following formula:

$$S=((1/2)\times C\times V^2)/(u\times l)/(n\times f)$$

wherein n is the number of lamps, f(Hz) is a lighting frequency, V(V) is an input voltage, C(μF) is a capacitor capacity, u(mm/sec) is a process conveying speed, and l(mm) is a printing width.

Moreover, although the emission time of the flash light can be widely varied according to the emission energy density of the light source or the like, normally the emission time is preferably within a range of about 500 μsec to about 3,000 μsec. If the emission time of the flash lighting is too short, the toner cannot be melted to a sufficient degree to raise the rate of flash fusing. Moreover, if the emission time of the flash lighting is too long, there is a possibility of overheating of the toner fused on the recording medium.

Furthermore, it is also recommended that halogen flash fusing be used together with the flash fusing in order to acquire long period stability with good fusing of a color toner. Moreover, according to an object, a well-known fusing device such as a heat roller fusing device may be used together with the flash fusing.

EXAMPLES

In the following the present invention will be described using specific examples and comparative examples, but the present invention is not limited to the following examples and numerous variations and modifications are possible within the scope and the sprit of the invention.

In the following experiments, magnetic powders 1 to 4 having varied remanent magnetizations, coercivities, and shapes, as shown in Table 1, were used.

Examples 1-17

The toners 1-17 were manufactured as follows. As the binding resin, a polyester resin manufactured by Kao Corporation (a resin using the ethylene oxide of bisphenol A as a main diol component, and terephthalic acid and trimellitic acid as main carboxylic acid components was used. As the negative polarity charge control agent, S-34 manufactured by Orient Chemical Industries, Ltd. was used. As the wax, polypropylene series wax NP105 manufactured by Mitsui Chemicals, Inc. was used. As the magnetic substance, the magnetic powder 1-4 shown in Table 1 was used. As the pigments, a phthalocyanine pigment (C. I. Pigment Blue 15:3, and remanent magnetization 0 A·m$^2$/kg) and/or particles (remanent magnetization 0.6 A·m$^2$/kg, Mn content 22 mass %, calcination temperature 850° C.) having the Mn containing hematite structure were used. The loading of each material was adjusted as shown in Table 2. The materials were placed into the Henschel mixer, and preliminary mixing of the materials was performed for 5 minutes. After that, the mixture was melted and kneaded to disperse each component into the binder resin, and then the mixture was solidified. The solidified mixture was then ground and classified. Thus, negative charging property black toner matrix having an average particle diameter of 9 μm was obtained. Then, the toners 1-17 were obtained by performing the external adding processing of 0.5 mass part of hydrophobic silica as an externally added agent to the toner matrix.

The average grain diameters of the toners were obtained as follows. As measurement equipment, a MULTISIZER II COULTER COUNTER manufactured by Beckman Coulter, Inc. was used. As an electrolyte, ISOTON-II manufactured by Beckmann Coulter, Inc. was used. As a measuring method, 0.5-50 mg of measurement samples were added as dispersing agents into 5% aqueous solution of 2 mL of a surface active agent (sodium alkylbenzenesulfonate), the aqueous solution was added in 100-150 mL of the electrolyte, and the dispersing processing of the electrolyte, in which the samples were suspended, was performed for about one minute with an ultrasonic distributor. The particle size distribution of the particles of 2-60 μm was then measured with the MULTISIZER II COULTER COUNTER using an aperture of 100 μm as the diameter of the aperture. A volume average distribution and a number average distribution were obtained. The number of the particles to be measured was set as 100,000. A volume mean particle diameter was obtained from these obtained volume average distribution and the number average distribution.

Thus, the obtained toners 1-17 were manufactured with manganese-magnesium (Mn—Mg) series ferrite carriers (average particle diameter: 70 μm, saturated magnetization 90 A·m$^2$/kg) at 4.5% of toner concentration for 30 minutes at 100 rpm using ball mill equipment, and the developers 1-17 were obtained.

Comparative Examples 1-7

Toners 18 to 24 were further obtained as comparative examples having respective components and respective loadings shown in Table 2, using the same toner production method as described for toner 1. Moreover, the developers 18 to 24 were obtained from the toners 18 to 24 obtained by the above-mentioned way by the same production method as that of the developer 1.

The developers 1 to 24 were severally installed in a reconstructed Fujitsu model F6761E printer, and a xenon flash having an emission intensity in the wavelength range of from 700 nm to 1500 nm was radiated to fuse the toners on plain paper ("NIP-1500LT" manufactured by Kobayashi Kirokushi Co., Ltd.).

The MICR properties were evaluated by reading a character of a MICR font printed in a specified position using the "MICR MINI RS232XT/PS2COMP" manufactured by Magtek Inc. When all characters were read correctly in each of 20 tests, the results were evaluated as "Excellent", while any failure in even one of the 20 readings was evaluated as "Poor." The measurements of a* values and b* values were performed using X-Rite 938 Spectrodensitmeter manufactured by X-Rite Ltd. The criteria of the judgment are shown in Table 4. Moreover, as for the rates of fusing, 1-inch images were printed on plain paper, and the printing densities were measured using a Macbeth RD918 manufactured by Gretag Macbeth AG. Tape exfoliation examination of the plain paper as described below was performed, and the fusing capability of toners were evaluated. A toner having the printing density change of 5% or less (95% or more of fusing rate) was evaluated as "Excellent", toners having a printing density change of 10% or less (90% or more of fusing rate) were evaluated as "Very good", toners having a printing density change of 20% or less (80% or more of fusing rate) were evaluated as "Good", and any toners having a printing density change exceeding 20% (under 80% of fusing rate) were evaluated as "Poor." The development properties were evaluated by potential differences (set values of development bias potential (Vb)) in the case of producing the amount of adhesion of 0.5 mg/cm$^2$ of the image of 1-inch page. The criteria of the judgment are shown in Table 4. Moreover, the difference between the surface potential (Vs) and the development bias potential (Vb) was set to be 250 V, and both the potential was adjusted by moving always in parallel to each other.

[Fusing Capability Examination Method (Tape Exfoliation)]

First, the image printing densities of toner images fused on plain paper were measured as optical densities using a Macbeth RD 918 manufactured by Gretag Macbeth AG. Subsequently, after exfoliation tapes ("Scotch Mending Tape" manufactured by Sumitomo 3M Limited) were stuck to the toner images on the plain paper, the exfoliation tapes were exfoliated, and the optical densities on the plain paper after exfoliation were measured in the manner described above. Then, the image printing densities on the plain paper after the exfoliation were expressed by the percentages wherein the image printing density on the plain paper before the exfoliation was set to 100, and the percentages were evaluated as toner fusing capability.

The evaluation results are shown in Table 3. In the examples 1-17, although the MICR reading performances were satisfactory, in the case of the comparative examples 1, 2, and 7, the reading failures occurred. Because the comparative example 2 had much quantity of magnetic powder (35 mass %), the development property also was problematic. Moreover, although, in the examples 1-17, the a* values and the b* values improved from a cyan color/brown color by loading respective predetermined amounts of the magnetic powder and the pigments, in the comparative example 3 using no pigments and the comparative examples 1, 4, and 5 containing the magnetic power and the pigments the quantities of which were not the predetermined quantities, none of the degrees of blackness were good. Moreover, in the comparative example 6 containing more quantity of the pigment than the predetermined quantity, although the magnetic property and the degree of blackness were good, because the quantity of resin decreased relatively, fusing property was problematic. Thus, it was demonstrated that by including a magnetic substance in a toner pigment, and making the contents of the magnetic substance and the pigment within the ranges defined by the present invention, the magnetic property between a toner and a carrier could be balanced, and the magnetic black toner for electrophotography satisfying the degree of blackness and the magnetic two-component developer for electrophotography containing the magnetic black toner could be obtained.

The entire disclosure of Japanese Patent Application No. 2004-371576 filed on Dec. 22, 2004 including the specification, claims, drawings, and abstract is incorporated herein by reference.

TABLE 1

| | REMANENT MAGNETIZATION [A · m$^2$/kg] | COERCIVITY [kA/m] | SHAPE | L1/L2 |
|---|---|---|---|---|
| MAGNETIC POWDER 1 | 32 | 30 | Needle | 10 |
| MAGNETIC POWDER 2 | 10 | 10 | Needle | 2 |
| MAGNETIC POWDER 3 | 7 | 7 | Globe | 1.1 |
| MAGNETIC POWDER 4 | 45 | 45 | Needle | 10 |

TABLE 2

| | POLYESTER RESIN MASS PART | CHARGE CONTROL AGENT MASS PART | WAX MASS PART | EXTERNALLY ADDED AGENT MASS PART | MAGNETIC POWDER 1 MASS PART | MAGNETIC POWDER 2 MASS PART | MAGNETIC POWDER 3 MASS PART | MAGNETIC POWDER 4 MASS PART |
|---|---|---|---|---|---|---|---|---|
| EXAMPLE 1 | 76 | 2 | 1 | 0.5 | 20 | | | |
| EXAMPLE 2 | 86.75 | 2 | 1 | 0.5 | 10 | | | |
| EXAMPLE 3 | 81.5 | 2 | 1 | 0.5 | 15 | | | |
| EXAMPLE 4 | 70.5 | 2 | 1 | 0.5 | 25 | | | |
| EXAMPLE 5 | 65 | 2 | 1 | 0.5 | 30 | | | |
| EXAMPLE 6 | 64 | 2 | 1 | 0.5 | 30 | | | |
| EXAMPLE 7 | 57 | 2 | 1 | 0.5 | 20 | | | |
| EXAMPLE 8 | 57 | 2 | 1 | 0.5 | 10 | | | |
| EXAMPLE 9 | 57 | 2 | 1 | 0.5 | 15 | | | |
| EXAMPLE 10 | 57 | 2 | 1 | 0.5 | 25 | | | |
| EXAMPLE 11 | 57 | 2 | 1 | 0.5 | 30 | | | |
| EXAMPLE 12 | 62 | 2 | 1 | 0.5 | 30 | | | |
| EXAMPLE 13 | 47 | 2 | 1 | 0.5 | 10 | | | |
| EXAMPLE 14 | 86.75 | 2 | 1 | 0.5 | | 10 | | |
| EXAMPLE 15 | 65 | 2 | 1 | 0.5 | | | | 30 |
| EXAMPLE 16 | 76 | 2 | 1 | 0.5 | 18 | | 2 | |
| EXAMPLE 17 | 56 | 2 | 1 | 0.5 | 20 | | | |
| COMPARATIVE EXAMPLE 1 | 91.75 | 2 | 1 | 0.5 | | 5 | | |

TABLE 2-continued

| | | | | | | | |
|---|---|---|---|---|---|---|---|
| COMPARATIVE EXAMPLE 2 | 59 | 2 | 1 | 0.5 | | | 35 |
| COMPARATIVE EXAMPLE 3 | 82 | 2 | 1 | 0.5 | 15 | | |
| CONPARATIVE EXAMPLE 4 | 86.95 | 2 | 1 | 0.5 | 10 | | |
| COMPARATIVE EXAMPLE 5 | 63 | 2 | 1 | 0.5 | 30 | | |
| COMPARATIVE EXAMPLE 6 | 37 | 2 | 1 | 0.5 | 10 | | |
| COMPARATIVE EXAMPLE 7 | 57 | 2 | 1 | 0.5 | | | 35 |

| | PHTHALOCYANINE PIGMENT(X) MASS PART | Mn HEMATITE (Y) MASS PART | α VALUE | B VALUE | REMANENT MAGNETIZATION OF TONER [A · m²/kg] | COERCIVITY OF TONER [kA/m] | AVERAGE PARTICLE DIAMETER OF TONER [μm] |
|---|---|---|---|---|---|---|---|
| EXAMPLE 1 | 1 | | 20 | | 8 | 30 | 9 |
| EXAMPLE 2 | 0.25 | | 40 | | 6 | 30 | 9 |
| EXAMPLE 3 | 0.5 | | 30 | | 7 | 30 | 9 |
| EXAMPLE 4 | 1.5 | | 17 | | 9 | 30 | 9 |
| EXAMPLE 5 | 2 | | 15 | | 10 | 30 | 9 |
| EXAMPLE 6 | 3 | | 10 | | 10 | 30 | 9 |
| EXAMPLE 7 | | 20 | | 1.00 | 8 | 30 | 9 |
| EXAMPLE 8 | | 30 | | 0.33 | 6 | 30 | 9 |
| EXAMPLE 9 | | 25 | | 0.60 | 7 | 30 | 9 |
| EXAMPLE 10 | | 15 | | 1.67 | 9 | 30 | 9 |
| EXAMPLE 11 | | 10 | | 3.00 | 10 | 30 | 9 |
| EXAMPLE 12 | | 5 | | 6.00 | 10 | 30 | 9 |
| EXAMPLE 13 | | 40 | | 0.25 | 6 | 30 | 9 |
| EXAMPLE 14 | 0.25 | | 40 | | 5 | 20 | 9 |
| EXAMPLE 15 | 2 | | 15 | | 20 | 40 | 9 |
| EXAMPLE 16 | 1 | | 20 | | 7 | 29 | 9 |
| EXAMPLE 17 | 1 | 20 | 20 | 1.00 | 8 | 30 | 9 |
| COMPARATIVE EXAMPLE 1 | 0.25 | | 20 | | 3 | 18 | 9 |
| COMPARATIVE EXAMPLE 2 | 3 | | 12 | | 25 | 43 | 9 |
| COMPARATIVE EXAMPLE 3 | | | 0 | | 7 | 30 | 9 |
| CONPARATIVE EXAMPLE 4 | 0.05 | | 200 | | 6 | 30 | 9 |
| COMPARATIVE EXAMPLE 5 | 4 | | 8 | | 10 | 30 | 9 |
| COMPARATIVE EXAMPLE 6 | | 50 | | 0.20 | 6 | 30 | 9 |
| COMPARATIVE EXAMPLE 7 | | 5 | | 7.00 | 6 | 30 | 9 |

TABLE 3

| | | TONER CONCENTRATION | MICR READ-IN | FUSING CAPABILITY | DEGREE OF BLACKNESS | a* | b* | DEVELOPMENT PROPERTY |
|---|---|---|---|---|---|---|---|---|
| 1 | EXAMPLE 1 | 4.5% | Excellent | Excellent | Excellent | 0.9 | 0.9 | Excellent |
| 2 | EXAMPLE 2 | 4.5% | Excellent | Excellent | Good | 1.5 | 4.5 | Excellent |
| 3 | EXAMPLE 3 | 4.5% | Excellent | Excellent | Very good | 0.0 | 2.7 | Excellent |
| 4 | EXAMPLE 4 | 4.5% | Excellent | Excellent | Very good | 1.5 | 0.5 | Excellent |
| 5 | EXAMPLE 5 | 4.5% | Excellent | Excellent | Very good | 2.5 | 0.2 | Very good |
| 6 | EXAMPLE 6 | 4.5% | Excellent | Excellent | Good | 4.0 | 0.0 | Very good |
| 7 | EXAMPLE 7 | 4.5% | Excellent | Excellent | Excellent | 0.8 | 0.5 | Excellent |
| 8 | EXAMPLE 8 | 4.5% | Excellent | Excellent | Excellent | 0.8 | 0.5 | Excellent |
| 9 | EXAMPLE 9 | 4.5% | Excellent | Excellent | Excellent | 0.7 | 0.6 | Excellent |
| 10 | EXAMPLE 10 | 4.5% | Excellent | Excellent | Excellent | 0.4 | 0.6 | Excellent |
| 11 | EXAMPLE 11 | 4.5% | Excellent | Excellent | Excellent | 0.5 | 0.2 | Very good |
| 12 | EXAMPLE 12 | 4.5% | Excellent | Excellent | Excellent | 0.7 | 0.8 | Very good |
| 13 | EXAMPLE 13 | 4.5% | Excellent | Very good | Excellent | 0.4 | 0.3 | Excellent |
| 14 | EXAMPLE 14 | 4.5% | Excellent | Excellent | Good | 1.5 | 4.5 | Excellent |
| 15 | EXAMPLE 15 | 4.5% | Excellent | Excellent | Very good | 2.5 | 0.2 | Very good |
| 16 | EXAMPLE 16 | 4.5% | Excellent | Excellent | Excellent | 0.9 | 0.9 | Excellent |
| 17 | EXAMPLE 17 | 4.5% | Excellent | Excellent | Excellent | 0.2 | 0.3 | Excellent |
| 18 | COMPARATIVE EXAMPLE 1 | 4.5% | Poor | Excellent | Poor | 3.2 | 6.3 | Excellent |

TABLE 3-continued

| | | TONER CONCENTRATION | MICR READ-IN | FUSING CAPABILITY | DEGREE OF BLACKNESS | a* | b* | DEVELOPMENT PROPERTY |
|---|---|---|---|---|---|---|---|---|
| 19 | COMPARATIVE EXAMPLE 2 | 4.5% | Poor | Good | Good | 3.5 | 0.2 | Poor |
| 20 | COMPARATIVE EXAMPLE 3 | 4.5% | Excellent | Excellent | Poor | 3.2 | 5.1 | Excellent |
| 21 | COMPARATIVE EXAMPLE 4 | 4.5% | Excellent | Excellent | Poor | 3.0 | 6.0 | Excellent |
| 22 | COMPARATIVE EXAMPLE 5 | 4.5% | Excellent | Excellent | Poor | 5.2 | 0.5 | Very good |
| 23 | COMPARATIVE EXAMPLE 6 | 4.5% | Excellent | Poor | Excellent | 0.2 | 0.3 | Excellent |
| 24 | COMPARATIVE EXAMPLE 7 | 4.5% | Poor | Good | Excellent | 0.2 | 0.3 | Excellent |

TABLE 4

| CRITERIA OF JUDGMENT | MICR READ-IN | FUSING CAPABILITY | DEGREE OF BLACKNESS | DEVELOPMENT PROPERTY |
|---|---|---|---|---|
| Excellent | Readable for All 20 Readings | ≧95% | $\lvert a^*\rvert \leqq 1$ and $\lvert b^*\rvert \leqq 1$ | ≦300 V |
| Very good | | 90% ≦ and <95% | $\lvert a^*\rvert \leqq 3$ and $\lvert b^*\rvert \leqq 3$ | 300 V < and ≦400 V |
| Good | | 80% ≦ and <90% | $\lvert a^*\rvert \leqq 5$ and $\lvert b^*\rvert \leqq 5$ | 400 V < and ≦600 V |
| Poor | One or more Reading Failures occurred. | <80% | $\lvert a^*\rvert > 5$ or $\lvert b^*\rvert > 5$ | >600 V |

What is claimed is:

1. A magnetic black toner for electrophotography comprising a binding resin, a magnetic substance, and one pigment, wherein the pigment consists of an Mn containing hematite compound, and the content ratio of the magnetic substance and the pigment in the toner satisfy the following formulae:

$$10 \leqq A \leqq 30 \text{ and } 5 \leqq C \leqq 40, \text{ wherein}$$

A denotes the content ratio (mass %) of the magnetic substance in the toner and C denotes the content ratio (mass %) of the Mn containing hematite compound in the toner.

2. The magnetic black toner for electrophotography according to claim 1, wherein the values for A and C satisfy the following formulae:

$$10 \leqq A \leqq 30 \text{ and } 7 \leqq C \leqq 30.$$

3. The magnetic black toner for electrophotography according to claim 1, wherein the values for A and C further satisfy the following formulae:

$$A = \beta C (0.1 \leqq \beta \leqq 6).$$

4. The magnetic black toner for electrophotography according to claim 1, wherein the remanent magnetization of the toner is within a range of from about 5 $A \cdot m^2/kg$ to about 20 $A \cdot m^2/kg$, and the coercivity of the toner is within a range of from about 20 kA/m to about 40 kA/m.

5. The magnetic black toner for electrophotography according to claim 1, wherein the remanent magnetization of the toner is within a range of from about 5 $A \cdot m^2/kg$ to about 15 $A \cdot m^2/kg$, and the coercivity of the toner is within a range of from about 25 kA/m to about 35 kA/m.

6. The magnetic black toner for electrophotography according to claim 1, wherein the remanent magnetization of the toner is within a range of from about 5 $A \cdot m^2/kg$ to about 12 $A \cdot m^2/kg$, and the coercivity of the toner is within a range of from about 27 kA/m to about 33 kA/m.

7. The magnetic black toner for electrophotography according to claim 1, wherein the remanent magnetization of the magnetic substance is within a range of from about 10 $A \cdot m^2/kg$ to about 45 $A \cdot m^2/kg$, and the coercivity of the magnetic substance is within a range of from about 10 kA/m to about 45 kA/m.

8. The magnetic black toner for electrophotography according to claim 1, wherein the remanent magnetization of the magnetic substance is within a range of from about 20 $A \cdot m^2/kg$ to about 35 $A \cdot m^2/kg$, and the coercivity of the magnetic substance is within a range of from about 20 kA/m to about 35 kA/m.

9. The magnetic black toner for electrophotography according to claim 1, wherein the values |a| and |b| in an L*a*b* colorimetric system of a fused image formed by the toner are both less than or equal to about 5.0.

10. The magnetic black toner for electrophotography according to claim 1, wherein the values |a| and |b| in an L*a*b* colorimetric system of a fused image formed by the toner are both less than or equal to about 3.0, and the value of |L| in the L*a*b* colorimetric system of the fused image formed by the toner is more than or equal to about 10 and less than or equal to about 40.

11. The magnetic black toner for electrophotography according to claim 1, wherein the values |a| and |b| in an L*a*b* colorimetric system of a fused image formed by the toner are both less than or equal to about 1.0, and the value of |L| in the L*a*b* colorimetric system of the fused image formed by the toner is more than or equal to about 10 and less than or equal to about 30.

12. The magnetic black toner for electrophotography according to claim 1, the magnetic substance having a ratio L1/L2 of about 3 or more, wherein L1 denotes a length of the magnetic substance in a direction of a long axis, and L2 denotes a length of the magnetic substance in a direction of a short axis.

13. The magnetic black toner for electrophotography according to claim 1, the magnetic substance having a ratio L1/L2 of about 5 or more, wherein L1 denotes a length of the magnetic substance in a direction of a long axis, and L2 denotes a length of the magnetic substance in a direction of a short axis.

14. The magnetic black toner for electrophotography according to claim 1, wherein the Mn containing hematite compound has the volume resistivity value of about $10^5$ Ωcm or more.

15. The magnetic black toner for electrophotography according to claim 1, wherein the Mn containing hematite compound has the remanent magnetization value of about 2 $A \cdot m^2/kg$ or less.

16. A magnetic two-component developer for electrophotography comprising a toner and a carrier, wherein the toner comprises a binder resin, a magnetic substance, and one pigment, wherein the pigment consists of an Mn containing hematite compound, and the content ratio of the magnetic substance and the pigment in the toner satisfy the following formulae: $10 \leqq A \leqq 30$ and $5 \leqq C \leqq 40$, wherein A denotes the content ratio (mass %) of the magnetic substance in the toner and C denotes the content ratio (mass %)of the Mn containing hematite compound in the toner.

17. The magnetic two-component developer for electrophotography according to claim 16, wherein the saturated magnetization of the carrier is within a range of from about 30 $A \cdot m^2/kg$ to about 120 $A \cdot m^2/kg$.

* * * * *